US007387551B2

(12) United States Patent
Kurahashi

(10) Patent No.: US 7,387,551 B2
(45) Date of Patent: Jun. 17, 2008

(54) CONNECTOR CASE

(75) Inventor: Takaaki Kurahashi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/510,713

(22) Filed: Aug. 28, 2006

(65) Prior Publication Data

US 2007/0077828 A1 Apr. 5, 2007

(30) Foreign Application Priority Data

Sep. 9, 2005 (JP) ..... 2005-261457

(51) Int. Cl.
*H01R 9/22* (2006.01)

(52) U.S. Cl. ..... 439/936; 439/722; 439/670

(58) Field of Classification Search ..... 439/936, 439/722, 670

See application file for complete search history.

(56) References Cited

U.S. PATENT DOCUMENTS 4,957,876 A * 9/1990 Shibata et al. ..... 29/827
5,550,415 A 8/1996 Adachi et al.
6,236,557 B1 5/2001 Kashihara et al.
6,291,913 B1 9/2001 Nikawa et al.
6,390,854 B2 * 5/2002 Yamamoto et al. .... 439/620.15
6,964,575 B1 * 11/2005 Sailor ..... 439/76.1

FOREIGN PATENT DOCUMENTS

| | | |
|---|---|---|
| JP | A-07-213034 | 8/1995 |
| JP | A-2000-209824 | 7/2000 |
| JP | A-2001-016829 | 1/2001 |
| JP | A-2001-176617 | 6/2001 |
| JP | A-2002-033438 | 1/2002 |

* cited by examiner

*Primary Examiner*—Truc T Nguyen
(74) *Attorney, Agent, or Firm*—Oliff & Berridge, PLC

(57) ABSTRACT

A connector case has a connector part, a terminal, and a resin case. The connector part of a concave shape accommodates external connection terminals. One end of the terminal is the external connection terminal. The terminal is inserted in the resin case by insert molding. The connector part, the terminal, and the resin case are integrated in one body. A part of the terminal other than the external connection terminal is exposed to the outside of the resin case as a resin case terminal. The resin case has a resin injection part of a concave shape accommodating a middle part of the terminal between the external connection terminal and the resin case terminal, namely, the middle part is exposed in the resin injection part and is filled with an encapsulating resin completely.

10 Claims, 5 Drawing Sheets

CONNECTOR CASE

CROSS-REFERENCE TO RELATED APPLICATIONS

This application is related to and claims priority from Japanese Patent Application No. 2005-261457 filed on Sep. 9, 2005, the contents of which are hereby incorporated by reference.

BACKGROUND OF THE INVENTION

1. Field of the Invention

The present invention generally relates to a connector case with an improved airtightness consisting of a female connector, to be jointed to a male connector, mounted on a vehicle alternator.

2. Description of the Related Art

Recently, the mounting space for a vehicle alternator becomes more and more limited because of reduction of an engine-mounting space in a vehicle caused by a tendency of slant-nose at a front part of a vehicle for reducing running resistance of a vehicle such as air resistance and needs to enlarge a vehicle compartment space. For such reasons, the vehicle alternator is mounted on a bottom side of the vehicle or piping of a reservoir tank, a brake fluid tank, or a water pump are mounted over or near the vehicle alternator in the vehicle.

When a vehicle alternator is mounted on a bottom side of a vehicle and the vehicle runs on muddy water of a road, the possibility of watering the vehicle alternator from the road is increased. In addition, on mounting various tanks of fluid materials over or near the vehicle alternator, the vehicle alternator is covered with the fluid materials if a supplemental mistake happens during the supplement of the fluid materials to those tanks.

Thus, the mounting environment for the vehicle alternator is deteriorating according to the various needs and demands of the vehicle technologies.

In addition, there is a strong demand to increase the airtightness of connectors mounted on a vehicle, which connect wirings through which control signals are transferred for electrical-communication control in order to perform detailed controls of electric generation of a vehicle alternator, for example, to increase the fuel consumption of an engine, and to reduce the occurrence of engine friction.

In general, a connector mounted on a vehicle alternator is integrated in one body as a part of a resin shield case in a voltage control device (as a voltage regulator). For example, various prior art documents have disclosed such a technique. For example, see on pages 4 to 6, FIG. 1 to FIG. 7 in the Japanese patent laid open publication number JP 2001-16829 where each end part of connector terminals placed in a connector case and exposed to the outside of the connector case is embedded in a resin shield case formed by insert molding and another end part of each connector terminal is exposed as a metal terminal to the outside of the connector case.

By the way, the connector case mounted on a vehicle alternator has a waterproof or moisture-proof capability and is protected by encapsulating rubbers and others placed between an engaging portion between the connector part of the connector case of the vehicle alternator and a connector part for external wirings. However, it is difficult to adhere closely resin with insert-molded terminals in an encapsulating resin case for a voltage regulator placed in the vehicle alternator. For example, even if the resin adheres closely with the insert-molded terminals during a manufacturing process, a crack or a small gap is easily generated between the resin and the insert-molded terminals by heat stress and heat expansion in thermal cycle operation of an internal combustion engine mounted on the vehicle during usual running of the vehicle because of different coefficients of thermal expansion of them and others. When end parts of the metal terminals are exposed to the outside of the encapsulating resin case, through such a crack or a small gap, water or moisture is entered into the inside of the encapsulating resin case, and in the worst case, the water or moisture reaches to the inside of the connector part through the terminal, and the airtightness of the encapsulating resin case is deteriorated.

SUMMARY OF THE INVENTION

It is an object of the present invention to provide a connector case with an improved airtightness of the inside of the connector case.

To achieve the above object, the present invention provides a connector case having a terminal, a connection part, and a resin case. The terminal has an external connection terminal as one end part thereof, a middle part, and a resin case terminal as the other end thereof. In the connector part of a concave shape, the external connection terminal is accommodated and exposed to the outside. The resin case, integrated with the connector part in one body, into which the terminal is inserted as an inserting mold, has a resin injection part of a concave shape. In the resin injection part, the middle part of the terminal between the external connection terminal and the resin case terminal is exposed and accommodated. The resin injection part and the middle part accommodated therein are filled with an encapsulating resin.

Thus, the middle part, between the external connection part and the resin case terminal, inserted in the resin case, is exposed in the resin injection part of a concave shape formed in the resin case. The resin injection part and the middle part of the terminal are filled with an encapsulating resin. The surface of the middle part is thereby sealed completely with the encapsulating resin. Accordingly, even if a crack or a small gap is generated between the resin case terminal and the resin case, it is possible to prevent extending such a crack or a small gap to the connector part through the terminal by the presence of the encapsulating resin in the resin injection part, and thereby possible to increase the air tightness of the connector part in the connector case.

Further, it is preferred to form the terminal consisting of the external connection terminal, the middle part, and the resin case terminal with a single electrode member. Accordingly, even if a crack or a small gap is generated between the resin case terminal and the resin case, it is possible to prevent completely extending such a crack or a small gap to the connector part through the terminal by the presence of the encapsulating resin and the middle part placed in the resin injection part of the resin case.

Still further, it is preferred to form the terminal consisting of the external connection terminal, the middle part, and the resin case terminal with at least two electrode members and preferred that the divided electrode members are electrically connected at the middle part of the terminal placed in the resin injection part of the resin case. Accordingly, because the middle part of the terminal is exposed in the resin injection part of the resin case, it is possible to easily form the terminal with two electrode members and to electrically connect the two electrode members at the exposed middle part in the resin injection part, and also to prevent extending such a crack or a small gap generated between the terminal and the resin case at the middle part of the terminal by the presence of the encapsulating resin.

Still further, it is preferred to form the resin injection parts in both a front surface and a back surface of the resin case, and to expose the middle part of the terminal in the resin injection parts of both the front surface and the back surface of the resin case. Accordingly, the two faces of the middle part of the terminal are exposed in opposite directions and the resin injection parts in both surfaces are filled with an encapsulating resin, even if a crack or a small gap is generated between the resin case terminal and the resin case, it is possible to prevent extending such a crack or a small gap to the connector part through the terminal by the presence of the encapsulating resin in both the surfaces of the resin case, and thereby possible to increase the air tightness of the connector part.

Moreover, it is preferred to insert an electric element capable of absorbing electromagnetic noises input into the external connection terminal in the resin injection part of the resin case, and preferred that the resin injection part accommodating both the middle part of the terminal and the electric element is completely filled with the encapsulating resin. Further, it is preferred to mount such a resin case on a vehicle alternator, and to insert a capacitance (as a surge absorber) for absorbing surge generated at output terminals of the vehicle alternator into the resin injection part, and preferred that the resin injection part accommodating the middle part of the terminal and a capacitor element is filled with the encapsulating resin. Accordingly, it is possible to increase the degree of airtightness of the connector part in the connector case without increasing design cost and manufacturing cost only by changing the design of the connector case so that the middle part of the terminal is exposed into the resin injection part of a concave part in the resin case into which the electric element and the capacitor element are inserted, placed, and filled with the encapsulating resin.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
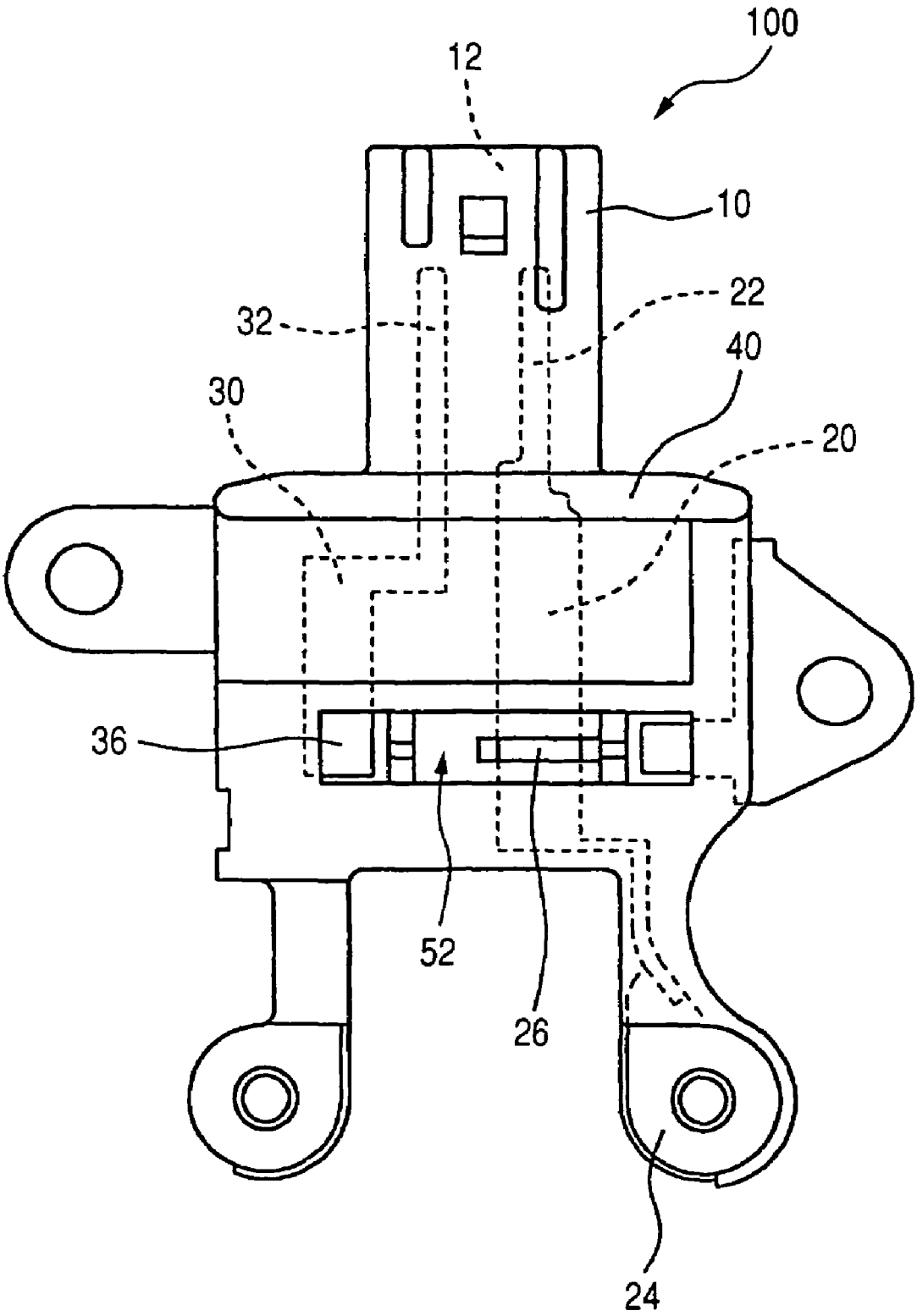
FIG. 1 is a front view of a connector case before performing an encapsulating mold process of injecting an encapsulating resin into a resin injection part of a resin case according to an embodiment of the present invention.

Hereinafter, various embodiments of the present invention will be described with reference to the accompanying drawings. In the following description of the various embodiments, like reference characters or numerals designate like or equivalent component parts throughout the several diagrams.

Embodiment

A description will be given of a connector case to which the concept of the present invention is adopted with reference to drawings.

Figure 2:
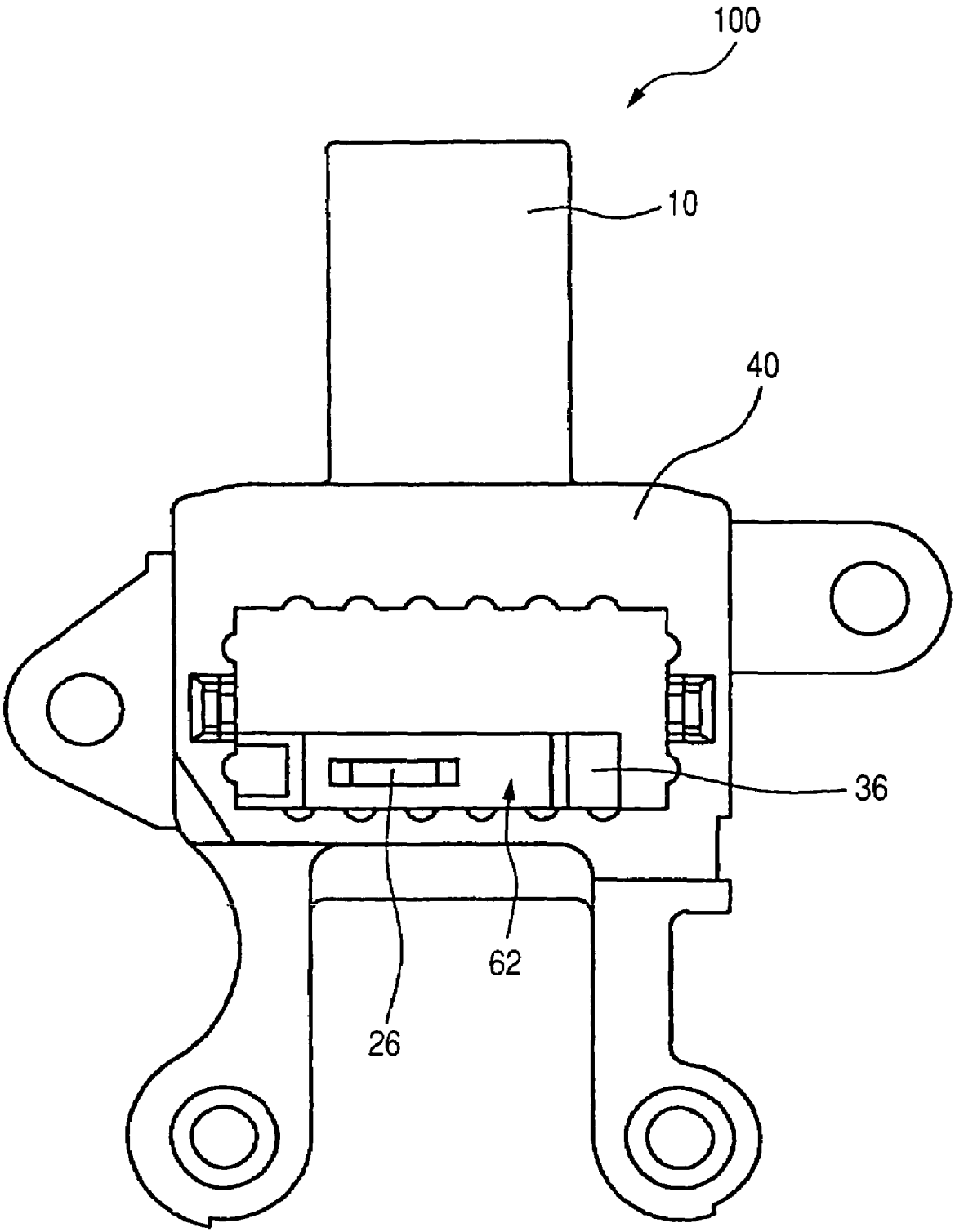
FIG. 2 is a back view of the connector case shown in FIG. 1 before performing the encapsulating mold process of injecting an encapsulating resin into another resin injection part of the resin case.
Figure 3:
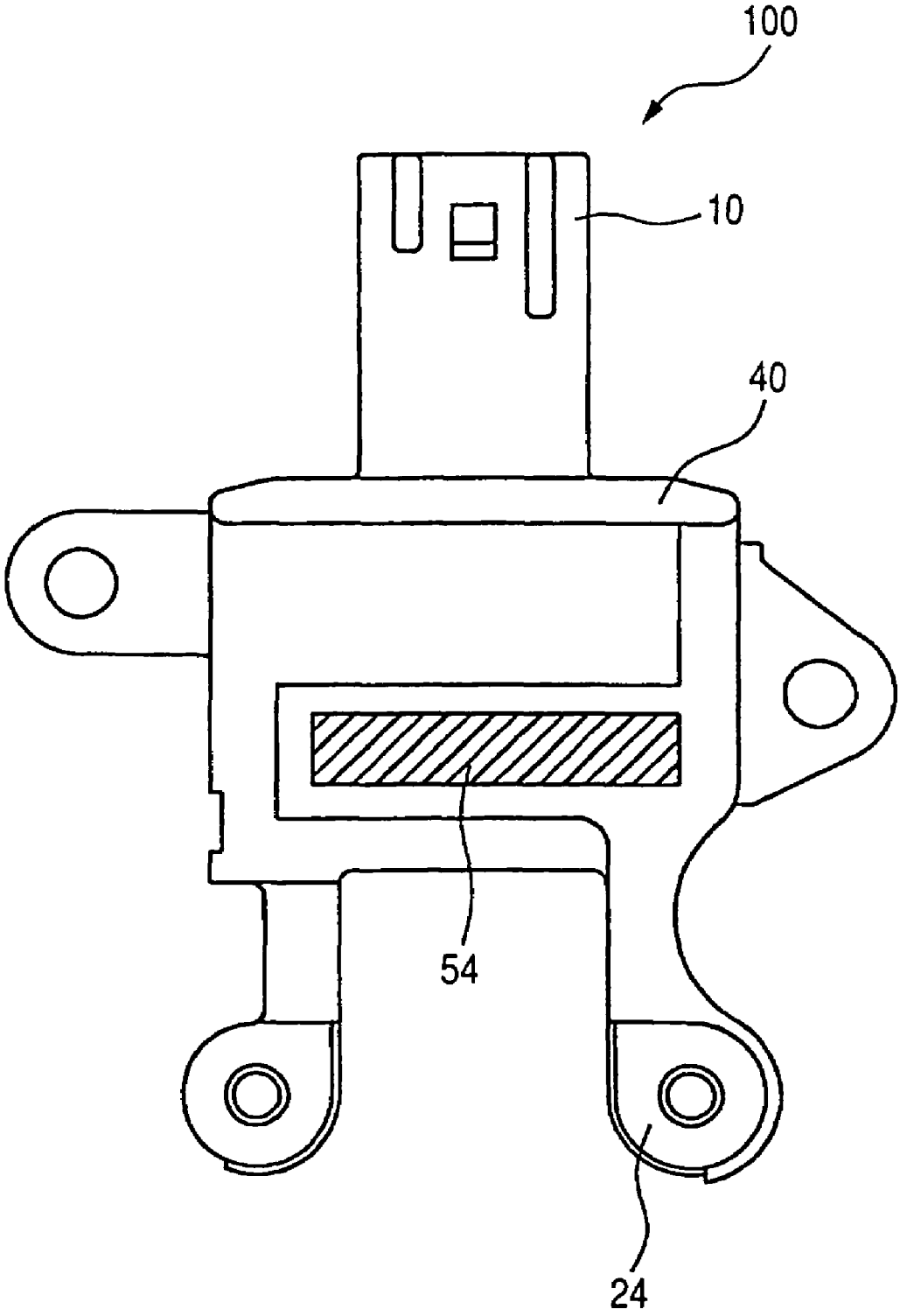
FIG. 3 is a front view of the connector case after the completion of the encapsulating mold process of injecting the encapsulating resin into the resin injection part of the resin case.
Figure 4:
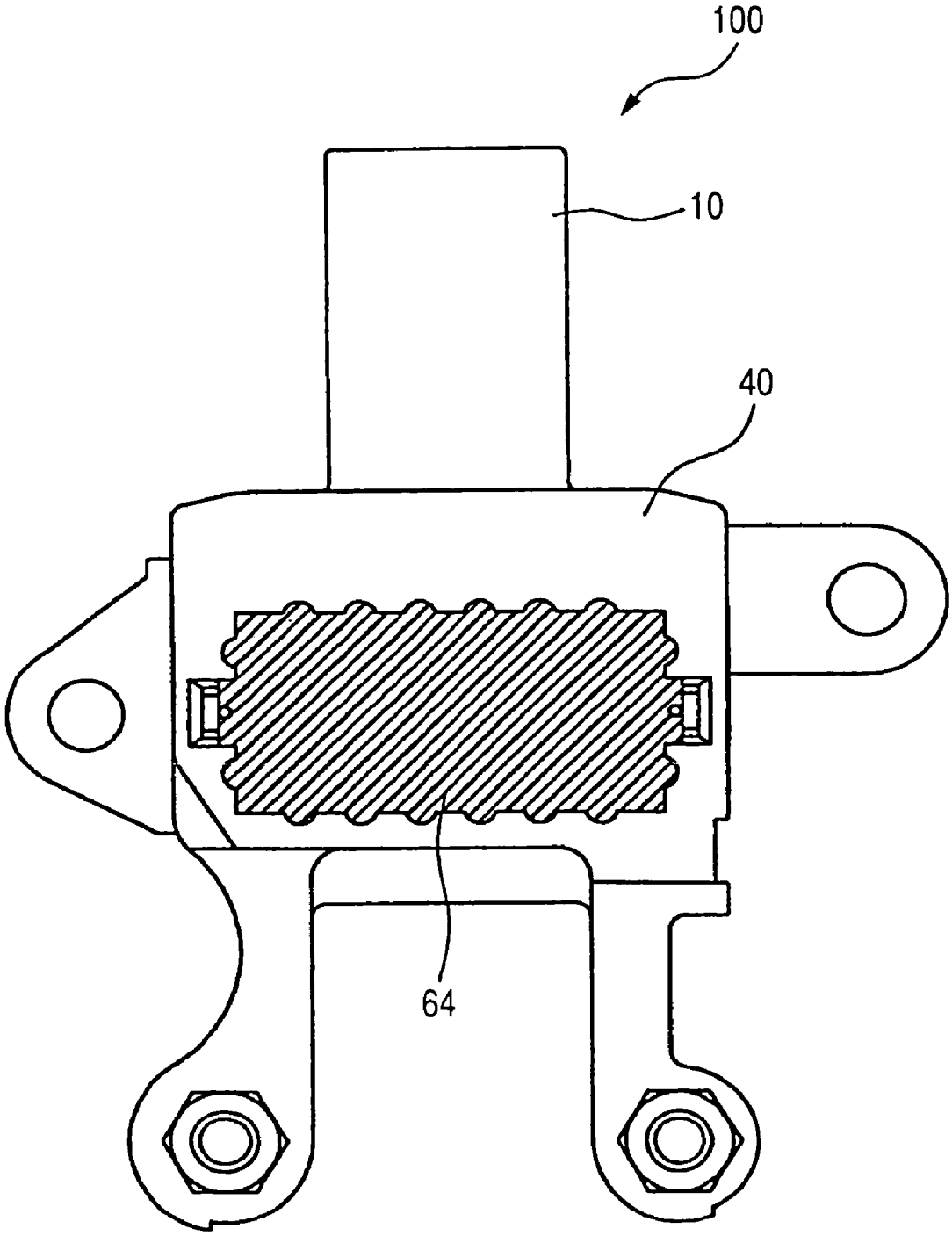
FIG. 4 is a back view of the connector case shown in FIG. 3 after the completion of the encapsulating mold process of injecting the encapsulating resin into the resin injection part of the resin case.
Figure 5:
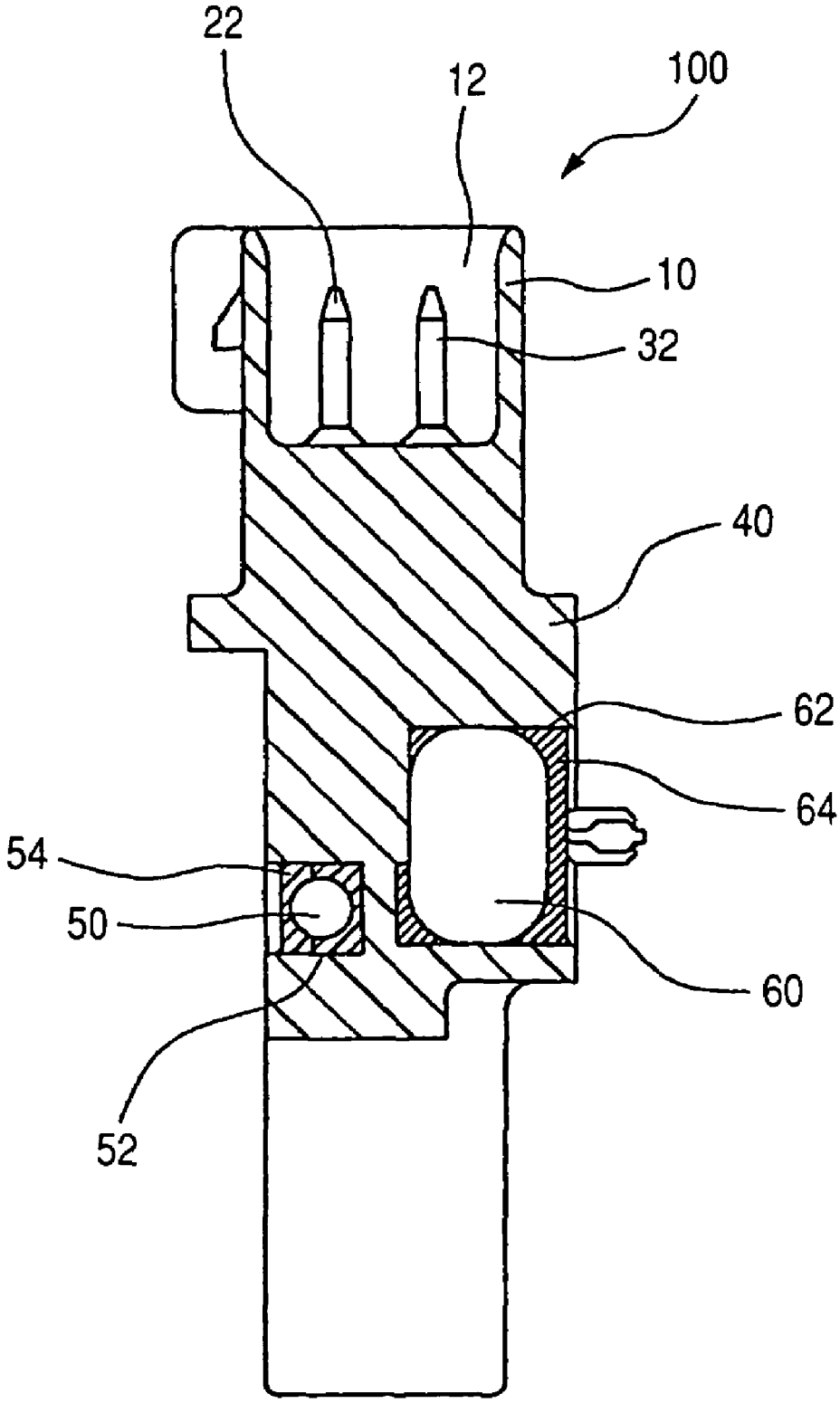
FIG. 5 is a longitudinal sectional view of the connector case after the completion of the encapsulating mold process of injecting the encapsulating resin into both the resin injection parts of the resin case.

FIG. 1 is a front view of a connector case 100 before performing an encapsulating mold process for injecting an encapsulating resin into a resin injection part 52 of a concave shape in a resin case according to a preferred embodiment of the present invention. FIG. 2 is a back view of the connector case 100 shown in FIG. 1 before performing the encapsulating mold process of injecting an encapsulating resin into another resin injection part 62 of a concave shape in the resin case. FIG. 3 is a front view of the connector case 100 after the completion of the encapsulating mold process of injecting the encapsulating resin 54 into the resin injection part 52 of the resin case. FIG. 4 is a back view of the connector case 100 shown in FIG. 3 after the completion of the encapsulating mold process of injecting the encapsulating resin 64 into the resin injection part 62 of the resin case. FIG. 5 is a longitudinal sectional view of the connector case 100 after the completion of the encapsulating mold process of injecting the encapsulating resin into both the resin injection parts 52 and 62 of the resin case.

The connector case 100 shown in FIG. 1 to FIG. 5 is mounted on a vehicle alternator (omitted from the drawings), for example. The connector case 100 is used for inputting/outputting various control signals transferred between a voltage regulator and external controllers. The voltage regulator is capable of controlling the output voltage of the vehicle alternator.

As shown in FIG. 1 and FIG. 2, the connector case 100 of the embodiment has a connector part 10, terminals 20 and 30, and a resin case 40. The connector part 10 of a concave shape accommodates a part of each of external connection terminals 22 and 32. The resin case 40 and the connector part 10 are assembled in one body into which the terminals 20 and 30 are embedded by insert molding.

The connector part 10 is a female connector having the concave part 12 (see FIGS. 1, 3, and 5, in particular, see FIG. 5) in which the external connection terminals 22 and 32 are exposed to the outside of the connector case 100.

In a vehicle, the external connection terminals 22 and 32 are joined to connection terminals embedded in a male connector (omitted from the drawings). That is, the concave part 12 of the connector part 10 as a female connector is joined tightly to a convex part of the male connector (not shown), and an encapsulating rubber or an O-ring seal is placed between both the female connector and the male connector for increasing the airtightness of a space formed between them. In this space made by the female connector and the male connector joined to each other, the external connection terminals 22 and 32 and terminals of the male connector (not shown) are joined and accommodated.

The resin case 40 has resin injection parts 52 and 62 of a concave shape as shown in FIG. 1, FIG. 2, and FIG. 5. The resin injection part 52 is formed at the center of a front side of the resin case 100, in which an electric element 50 (see FIG.

5) is accommodated. The resin injection part 62 is formed at the center of a back side of the resin case 100, in which a capacitor element 60 (as a surge absorber, see FIG. 5) is accommodated. The electric element 50 is a filter element capable of absorbing and of preventing propagation of electromagnetic noises input through the external connection terminals 22 and 32. The capacitor element 60 absorbs surge generated at output terminals of a vehicle alternator when ON and OFF operation of an exciting current is performed under the control of the voltage regulator (not shown).

The resin injection part 52 of a concave shape is sealed with an encapsulating resin 54 (see FIG. 3 and FIG. 5) after the electric element 50 is inserted therein and necessary electrical connection for the electric element 50 is then completed. Similar to the concave part 52, the resin injection part 62 of a concave shape is sealed with an encapsulating resin 64 (see FIG. 4 and FIG. 5) after the capacitor element 60 is inserted therein and necessary electrical connection for the capacitor element 60 is then completed. The encapsulating resins 54 and 64 are epoxy resin and injected into the resin injection parts 52 and 62, for example.

The terminal 20 is formed with a single electrode member such as a single electrode metal sheet, and one end thereof acts as the external connection terminal 22 that is exposed in the concave part 12 of the connector part 10, and the other end thereof is a resin-case terminal 24 that is exposed in the outside of the resin case 40. The terminal 20 has a middle part 26 between the external connection terminal 22 and the resin-case terminal 24. The middle part 26 of the terminal 20 is exposed in the resin injection part 52 of a concave shape (see FIG. 1 and FIG. 5) formed at the front side of the connector case 100. This middle part 26 of the terminal 20 is also exposed in the resin injection part 62 of a concave shape (see FIG. 2 and FIG. 5) at the back side of the connector case 100.

The other terminal 30 is also formed with a single electrode member such as a single electrode metal sheet, and one end thereof is the external connection terminal 32 that is exposed in the concave part 12 of the connector part 10, as shown in FIG. 1. The other terminal 36 is exposed in the resin injection part 52 of a concave shape (see FIG. 1 and FIG. 5) at the front side of the connector case 100. The other terminal 36 is also exposed in the resin injection part 62 of a concave shape (see FIG. 2 and FIG. 5) at the back side of the connector case 100.

In the connector case 100 of the embodiment, the external connection terminal 22 as the one end of the terminal 20 is exposed in the concave part of the connector 10 and the resin case terminal 24 as the other end of the terminal 20 is exposed in the outside of the resin case 40, and the terminal 20 as the middle part between the terminals 22 and 24 is inserted in the resin case 40.

The terminal 20 inserted in the resin case 40 has the middle part 26 exposed in both the resin injection parts 52 and 62 of a concave shape in the resin case 40. After the completion of the necessary electric connection between the middle part 26 and the electric element 50 which are accommodated in the resin injection part 52 of a concave shape shown in FIG. 5, the resin injection part 52 of a concave shape accommodating one face of the middle part 26 and the electric element 50 is filled with the encapsulating resin 54, as shown in FIG. 3 and FIG. 5.

On the contrary, similar to the resin injection part 52, after the completion of the necessary electric connection between the middle part 26 and the capacitor element 60 accommodated in the resin injection part 62 of a concave shape, the resin injection part 62 of a concave shape accommodating the other face of the middle part 26 and the capacitor element 60 is filled with an encapsulating resin 64, as shown in FIG. 4 and FIG. 5.

Thus, the resin injection parts 52 and 62 of a concave shape are completely filled with the encapsulating resins 54 and 64 against the outside of the connector case 100.

According to the resin case 100 having the configuration described above, even if a crack or a small gap is generated between the resin case 40 and the terminal 20 at the peripheral part of the resin case terminal 24, rainwater or moisture is entered into the inside of the resin case 40, the middle part 26 of the resin case 40 of the connector case 100 completely prevents any entering the rainwater or moisture by the presence of the sealing resins 54 and 62. It is therefore possible to prevent entering water or moisture into the inside of the connector part 10 through a gap or a crack generated between the terminal 20 and the resin case 40 and thereby possible to increase its airtightness and waterproof capability.

Experimental Results

The air leakage testing was performed by using two groups, one group including the connector cases 100 of the present invention, and another group including conventional connector cases of a conventional configuration. In the air leakage testing, the inside pressure of the connector part 10 of the connector case 100 was increased and air leakage through the terminal 20 was measured. The number of samples of each group to be tested is five, respectively.

In the conventional connector case having a conventional configuration in which the middle part 26 is exposed to the outside of the connector case, namely, not filled with any sealing resin, air leakage occurred at the pressure 7 kPa. On the contrary, the air leakage did not occur until 150 kPa in the connector case 100 of the present invention.

According to the experimental results, it is recognized that the airtightness of the connector part 10 of the connector case 100 of the present invention is drastically increased when compared with the conventional connector cases.

As described above, according to the connector case 100 of the present invention, because the middle part 26 between the external connection part 22 and the resin case terminal 24, and the terminal part 36 are inserted into the resin case 40 and exposed in the resin sealing parts 52 and 62 of a concave shape, it is possible to completely fill the resin injection parts 52 and 62 of a concave shape with the encapsulating resins 54 and 64, in which both the surfaces of the middle part 26 are placed. Even if a gap or a crack is generated between the resin case terminal 24 and the resin case 40, the presence of the encapsulating resins 54 and 64 can prevent extending such a gap or a crack to the connector part 10 and thereby increases the airtightness of the connector part 10 of the connector case 100. In particular, because the terminal 20 consisting of the external connection terminal 22, the middle part 26, and the resin case terminal 24 is made of a single electrode member such as a single electrode metal sheet and even if a small gap or a crack is generated between the resin case 40 and the terminal 20 embedded in the resin case 40 by inserting molding, the presence of the middle part 26 of the terminal 20 and the presence of the encapsulating resins 54 and 64 can completely cut extending such a gap and a crack to the connection part 10.

Further, because both the surfaces of the middle part 26 of the terminal 20 are exposed in opposite directions to each other, namely, in both the front surface and the back surface of the resin case 40, the resin injection parts 52 and 62 of a concave shape are filled with the encapsulating resin 54 and 64, it is possible to completely seal a gap and a crack generated along the terminal 20 and thereby possible to increase the airtightness of the connector part 10.

Still further, because it is so designed and formed that the middle part 26 of the terminal 20 is exposed in the resin injection parts 52 and 62 of a concave shape in which the electric element 50 and the capacitor element 60 are placed and the resin injection parts 52 and 62 of a concave shape are filled with the encapsulating resins 54 and 64, it is thereby possible to increase the airtightness of the connector part 10 of the connector case 100, without increasing the design cost and manufacturing cost.

The concept of the present invention is not limited by the configuration of the embodiment described above in which the connector case 100 consisting of the connector part 10 and the terminal 20 is incorporated in the voltage regulator (not shown) or a rectifier (not shown), it is possible to modify the configuration of the connector case 100 of the present invention. For example, it is possible to use the connector case 100 of the embodiment as a single part, not assembled with another device.

Still further, according to the embodiment of the present invention described above, the terminal 20 is made of a single metal electrode sheet. The concept of the present invention is not limited by this configuration of the connector case 100, for example, it is possible to form the terminal 20 made of two (or more) electrode members divided at the middle part 26. The two or more divided members are electrically connected to each other at the middle part 26 that is exposed in the resin injection parts 52 and 62 of a concave shape that are filled with the encapsulating resins 54 and 64, respectively.

Moreover, according to the embodiment of the present invention described above, the middle part 26 of the terminal 20 is exposed in the resin injection parts 52 and 62 of a concave shape in which the electric element 50 and the capacitor element 60 are placed, it is possible to form a resin injection part of a concave shape in which only the middle part 26 of the terminal 20 is placed and filled with the encapsulating resin.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalent thereof.

What is claimed is:

1. A connector case comprising:

a terminal consisting of an external connection terminal as one end part of the terminal, a middle part, and a resin case terminal as the other end of the terminal;

a connector part of a concave shape in which the external connection terminal is accommodated and exposed to the outside of the connector case; and a resin case, integrated with the connector part in one body, into which the terminal is inserted in an inserting mold, the resin case comprising a resin injection part of a concave shape in which the middle part of the terminal between the external connection terminal and the resin case terminal is exposed and accommodated, the resin injection part is filled with an encapsulating resin that seals the middle part, wherein the resin injection part is formed in both a front surface and a back surface of the resin case, and the middle part of the terminal is exposed in both the resin injection part of the front surface and the resin injection part of the back surface of the resin case.

2. The connector case according to claim 1, wherein the terminal consisting of the external connection terminal, the middle part, and the resin case terminal is made of a single electrode member.

3. The connector case according to claim 1, wherein the terminal consisting of the external connection terminal, the middle part, and the resin case terminal is made of at least two electrode members, and the divided electrode members are electrically connected at the middle part placed in the resin injection part of the resin case.

4. The connector case according to claim 1, wherein one resin injection part formed at one of both the surfaces of the resin case accommodates an electric element for absorbing electromagnetic noises input to the external connection terminal, and the other resin injection part formed at the other surface of the resin case accommodates a capacitor element for absorbing surge generated at output terminals of a vehicle alternator, and both the resin injection parts are sealed with the encapsulating resins.

5. A connector case comprising:

a terminal consisting of an external connection terminal as one end part of the terminal, a middle part, and a resin case terminal as the other end of the terminal;

a connector part of a concave shape in which the external connection terminal is accommodated and exposed to the outside of the connector case; and a resin case, integrated with the connector part in one body, into which the terminal is inserted in an inserting mold, the resin case comprising a resin injection part of a concave shape in which the middle part of the terminal between the external connection terminal and the resin case terminal is exposed and accommodated, the resin injection part is filled with an encapsulating resin that seals the middle part, wherein an electric element for absorbing electromagnetic noises input to the external connection terminal is inserted in the resin injection part and the resin injection part accommodating both the middle part and the electric element are filled with the encapsulating resin.

6. The connector case according to claim 5, wherein the terminal consisting of the external connection terminal, the middle part, and the resin case terminal is made of a single electrode member.

7. The connector case according to claim 5, wherein the terminal consisting of the external connection terminal, the middle part, and the resin case terminal is made of at least two electrode members, and the divided electrode members are electrically connected at the middle part placed in the resin injection part of the resin case.

8. A connector case comprising:

a terminal consisting of an external connection terminal as one end part of the terminal, a middle part, and a resin case terminal as the other end of the terminal;

a connector part of a concave shape in which the external connection terminal is accommodated and exposed to the outside of the connector case; and a resin case, integrated with the connector part in one body, into which the terminal is inserted in an inserting mold, the resin case comprising a resin injection part of a concave shape in which the middle part of the terminal between the external connection terminal and the resin case terminal is exposed and accommodated, the resin injection part is filled with an encapsulating resin that seals the middle part, wherein the resin case of the connector case is mounted on a vehicle alternator and a capacitor element for absorbing surge generated at output terminals of the vehicle alternator is inserted in the resin injection part, and the resin injection part accommodating the middle part of the terminal and the capacitor element are sealed with the encapsulating resin.

9. The connector case according to claim 8, wherein the terminal consisting of the external connection terminal, the middle part, and the resin case terminal is made of a single electrode member.

10. The connector case according to claim 8, wherein the terminal consisting of the external connection terminal, the middle part, and the resin case terminal is made of at least two electrode members, and the divided electrode members are electrically connected at the middle part placed in the resin injection part of the resin case.

* * * * *